US006186654B1

(12) United States Patent
Gunteret, Jr. et al.

(10) Patent No.: US 6,186,654 B1
(45) Date of Patent: Feb. 13, 2001

(54) PORTABLE AND MODULAR BATCHING AND MIXING PLANT FOR CONCRETE AND THE LIKE

(75) Inventors: Ronald M. Gunteret, Jr., Ripon, CA (US); William R. Cape; Christopher Cape, both of Racine, WI (US); Roberto Salgarollo, Herentals (BE); Lowell B. Campbell, Oakdale, CA (US)

(73) Assignee: Guntert & Zimmerman Construction Division, Inc., Ripon, CA (US)

( * ) Notice: Under 35 U.S.C. 154(b), the term of this patent shall be extended for 0 days.

(21) Appl. No.: 09/255,745

(22) Filed: Feb. 23, 1999

(51) Int. Cl.[7] ..... B28C 7/04

(52) U.S. Cl. ..... 366/18; 366/26; 366/27

(58) Field of Search ..... 366/18, 26, 27, 366/28, 30, 31, 32, 33, 41, 49; 414/334, 332, 21

(56) References Cited

U.S. PATENT DOCUMENTS 3,064,832 * 11/1962 Heltzel ..... 414/332
3,151,849 * 10/1964 Maxon, Jr. ..... 366/41
3,891,193 * 6/1975 Perry, Jr. ..... 366/31
3,938,673 * 2/1976 Perry, Jr. ..... 366/18
3,945,619 * 3/1976 Taibi ..... 366/18
4,178,117 * 12/1979 Brugler ..... 414/21
4,457,660 * 7/1984 Pippinger ..... 414/332
4,494,903 * 1/1985 Badicel et al. .
4,548,538 * 10/1985 Bruder et al. ..... 414/332
4,579,496 * 4/1986 Gerlach ..... 414/332
4,580,902 * 4/1986 Dunstan ..... 366/33
4,775,275 * 10/1988 Perry ..... 366/18
4,792,234 * 12/1988 Doherty ..... 366/18
4,943,200 * 7/1990 Edwards et al. ..... 414/332
4,944,646 * 7/1990 Edwards et al. ..... 414/332
5,121,989 * 6/1992 Horton et al. ..... 366/30
5,667,298 * 9/1997 Musil et al. ..... 366/18
5,730,523 * 3/1998 Flood ..... 366/18

OTHER PUBLICATIONS

RexCon Concrete Batch Plants and Controls, "Model S Batch Plant," www.rexcon.com/products/english/e batch/e models.html., Apr. 9, 1999, 2 pgs description, 2 pgs. pictures.

Erie Strayer Co., MG–11C Central Mix Batching Plants, "Mobile Gravity 11 Central Mix," Bulletin No. MG11C89, Feb. 1989.

(List continued on next page.)

*Primary Examiner*—Tony G. Soohoo
(74) *Attorney, Agent, or Firm*—Townsend and Townsend and Crew LLP

(57) ABSTRACT

A portable concrete plant capable of producing up to 240 to 300 cubic yards or more of concrete per hour is disclosed in which two hauling trailers, a mixer trailer and an aggregate trailer, both serve as the transport vehicles and as foundation for the completely erected plant. The aggregate trailer includes three bins used respectively for sand, fine aggregate and course aggregate. Weigh belts convey weighed and humidity measured amounts of sand and aggregate from discrete open top bins to a batch aggregate loading belt for batch loading of a compulsory mixer on the mixer trailer. The side of the aggregate trailer is provided with a bulkhead for an earthen or gravel ramp with large width bins enabling a single loader to supply the high volume of sand and aggregate required. The mixer trailer supports a twin shaft compulsory mixer on a foundation pad which is top loading for concrete constituents and bottom emptying to an elevating and concrete discharge point to awaiting trucks. Pivotally mounted to the mixer trailer from a horizontal transport disposition to a vertically erect operating position are a multi-compartment air loaded, gravity feed cement silo, and weigh hopper for batch weighing of concrete and discharge to the underlying compulsory mixer. Provision is made for the axles located at the rear of the trailer to steer so that precision joining of the plant components can easily occur.

17 Claims, 12 Drawing Sheets

OTHER PUBLICATIONS

Erie Strayer Co., Sentry/Scout Batching Control System, "Fast, Accurate, Reliable Batching Control Systems," Bulletin No. CP, Mar. 1999.

Erie Strayer Co., "Mobile Gravity and Central Mix Plant," Drawing No. 4A–219801, Jan. 7, 1991.

Erie Strayer Co., "Mobile Gravity, Central Mix Plant with Conc. Directional Chute," Drawing No. 4A–219802, Jan. 7, 1991.

Vince Hagan Co., "Super Haganator, 'Mobile Paver' Central Mix Concrete Plant System (2 to 12 cubic yards)," Bulletin 109, Nov. 15, 1977.

Vince Hagan Co., "10 Yard Central Mix Plant," Drawing No. S228, Apr. 20, 1982.

Heltzel Steel Form & Iron Co., "Self–Erect Mobile Central–Mix Batching Plants and Mobile Mixers," Bulletin No. 66–70R.

Johnson–Ross Concrete Plants, "Ranger 750," Bulletin No. 750–098.

* cited by examiner

PORTABLE AND MODULAR BATCHING AND MIXING PLANT FOR CONCRETE AND THE LIKE

This invention relates to a portable and modular batching and mixing plant or concrete, soil cement, cement stabilize base course and the like. Specifically, a two trailer portable plant is disclosed including a mixing trailer and an aggregate trailer. This two trailer plant is complete with aggregate storage, water tank, cement silo, admixture tanks, dust collection system and generator set. The two trailer configuration enables assembly and disassembly to and from the transport mode with three to four men in one 8 hour shift to enable portable batching and mixing plant assembly and disassembly time and transport to match that of a portable slipform paver. Thus, there results a highly portable and high capacity 240 to 300 cubic yard per hour or more batching and mixing plant results which can deliver uniformly mixed, low moisture soil cement, and cement stabilized base courses or low slump (low moisture content) concrete.

BACKGROUND OF THE INVENTION

In the discussion that follows, the prior art is set forth in terms of the need for this invention. It is to be understood that we claim invention both in the recognition of that need as well as the solution that follows.

Modern concrete paving practices impose more severe constraints on concrete quality every year. Specifically, concrete when freshly mixed is tested and measured for different desired qualities and standards pursuant to imposed and specified quality control standards. These standards include moisture content (or slump), both compressive and flexural strength after a prescribed number of days, aggregate shape, air content, and uniformity, to name a few. If the quality standards of the concrete produced vary statistically above or below the prescribed standard mean, then the concrete producer is penalized financially.

Exemplary of these standards would be concrete compressive strength where the concrete strength is to reach say 3,500 psi in 28 days. The specification might allow a variation of this standard of 5% above or below this mean or the contractor would be penalized.

It is generally agreed that higher strength concrete can be reached in a shorter period of time by better mixing action and lower water/cement (W/C) ratios. Thus the lower the concrete slump, the easier it is for the contractor to reach the specified strengths. The trend in the industry is toward lower W/C ratios. Low W/C ratio concrete mixed in conventional tilting drum mixers do not reach uniformity as quickly as the mixer used in this invention.

The cost of the concrete makes up the majority of the cost of the road being built. Given the large volumes of concrete processed in such paving contracts, supervisory and specifying authorities such as state and federal inspectors can only statistically sample the loads of concrete to determine the quality of the concrete delivered by the contractor. Because of the large quantity of concrete that can be produced by the contractor in a day, the contractor faces great financial risk if many days pass before he realizes the concrete he is producing is testing outside of specification mean. The above example is intended to show how important it is for the contractor to maintain quality control on the concrete he produces. It is imperative that the contractor use batching and mixing equipment capable of delivering uniformly mixed concrete of the low slump variety to precision construction specifications.

Modern paving practices also call for the use of slipform pavers, which in operation consume relatively large amounts of concrete. On a typical urban size paving job, where the total cubic yards of concrete to be used on the job is relatively small, a modern paver can consume concrete in the range of 240 to 300 cubic yards per hour. On larger jobs the contractor may choose to mobilize, produce and deliver concrete to the slipform paver at a higher rate with a larger plant with higher capacity. Exemplary of such a paver is that Slipform Paver sold under the designation of model S850 built by Guntert and Zimmerman of Ripon, Calif. The fundamental design of this model was pioneered by the late Ronald M. Guntert, Sr. of Stockton, Calif. as set forth in U.S. Pat. Nos. 4,493,584 and 5,135,333.

Other more recent examples of pavers consuming high volumes of concrete can be found in U.S. Pat. No. 5,590,977 entitled Four Track Paving Machine and Process of Transport by Ronald M. Guntert (herein) et al. And U.S. Pat. No. 5,615,972 entitled Paving Machine with Extended Telescoping Members by Ronald M. Guntert (herein).

As cement in the concrete starts to hydrate during transport to a paving site, portable concrete batching and mixing plants have been developed for mixing concrete adjacent the paving site. This reduces the hauling distance to where the concrete is being used and to reduce the number of concrete hauling units required. Simply stated, from a plant which mixes concrete to the site where such mixed concrete is placed, most contract specifications set a time limit of 30 minutes for non-agitating trucks, which is about a 12 mile transport limit. This practical transport limit is reduced in high traffic areas or other situations where the average speed at which the hauling unit can travel is reduced. If the time limit is exceeded, the concrete that is hauled will start to set before the paver places it and the paver placed concrete will not meet the required contract standards.

Secondly, and given the high quality constraints placed on the paved and/or placed concrete product, so-called continuous flow concrete plants have proven inadequate. Such plants are capable of delivering large volumes of concrete but do so on a continuous flow basis. The exacting standards of thorough mixing covered by precise constituent proportion make the continuous flow adjustment of such plants hazardous from the quality control standpoint. As a result, such continuous flow concrete plants have not been accepted in modem paving practice, at least in the North American paving market. It is only the processing of specific "batch" quantities of cement, water and aggregates that constitute concrete that enables the relatively high quality requirements to be maintained and conventional calibration and quality assurance measures to be used.

Prior art portable modem batching and mixing concrete plants are large, require concrete foundations and are difficult to erect, often consuming three to five days in assembly. Frequently, these plants require special rigging equipment, such as cranes to accomplish erection. Specifically, it is not uncommon for such plants to occupy 3 or more (sometimes as many as 7) transporting trailers. Further, such plants utilize rotating and tilting drum mixers located high overhead so they can tilt and gravity feed the mixed concrete into the hauling units. The mixer itself is belt fed with aggregates that are gravity fed through weighing hoppers to maintain precise concrete constituent proportions. This produces several undesirable features, which complicate the erection and subsequent operation of such plants:

First the feeding belt is usually gravity fed from overlying storage bins and weighing hoppers. Thus, considerable weight must be supported at substantial heights from the ground on such portable plants. Using weighing belts instead of weighing hoppers is novel in the U.S. for mixing concrete. In order to load the overlying storage bins that cannot be reached directly by a front end loader, separate charging conveyors with charging bins are used for each aggregate and sand. The charging bins are at an elevation that can be reached by a front-end loader. Because of the requirement of these charging conveyors and bins, the plant site required is quite large limiting the number of places the plant may be set up.

Second, such rotating drums must be tilted, and in a few cases, reversed in rotation for discharge. This tilting superimposes a moment requirement upon the weight support requirement of the rotating drum. As a result of the weight and moment requirements, most so-called portable concrete batching and mixing plants require concrete foundations. Further, in a few cases, reversing the mixing drum rotation not only interrupts mixing, but also consumes momentum, and utilizes heavy reversible drives.

Third, because the rotating mixer drums are supported high in the air, if the more desirable gravity feed of cement is used with the rotating mixer drum, the cement silo must be elevated even higher in the air. The resulting silo and structure requires concrete foundations. To save height, and in lieu of gravity feed from the silo to the cement batcher, many manufacturers of conventional concrete plants use cement screws or air slides to convey the cement into the mixer. Most contractors agree these cement-conveying schemes are undesirable although many times tolerated to minimize the silo height.

Four, because tilting drum mixers are open in front for discharge and open in the back for loading the concrete constituents into the mixer, it is very difficult to suppress the dust that results from the loading operation. The inability to adequately suppress the dust coming out of the mixers limits the use of the plant in many urban settings.

Five, because the tilting/rotating drum mixer rotates on rollers, can be driven by chain drives or gearbox driving gear on drum. The mixer drum is essentially open during the mixing process. As a result, these conventional mixers are very noisy which limits the use of this plant in many urban settings because of the high decibel readings produced.

Six, conventional batching and mixing plants are highly specialized. A contractor will own one plant for his jobs requiring concrete production of 200 to 300 cubic yards per hour and another complete plant when his concrete production needs are 400 to 500 cubic yards per hour. Generally, the larger the plant production capacity per hour the more cumbersome the plant is to transport, set-up and tear down.

Finally, rotating/tilting drum mixers are relatively slow in delivering desired amounts of thoroughly and uniformly mixed low slump concrete, base courses and soil cement. Rotating/tilting drum mixer has paddles affixed to the rotating drum wall. The limitation of this design is that dry material bridges in the mixer and does not discharge out of the drum readily. Moreover, when cement substitutes are used such as slags, the concrete tends to be sticky which again impedes rapid discharge. With low slump concrete or soil cement, this problem is amplified. As compared to contemporary twin shaft, compulsory mixers now utilized in Europe, longer mixing cycles are generally required for the same material in rotating/tilting drum mixers. With low slump or difficult mix designs, rotating/tilting drum mixers produce less than thorough mixing with resultant "ribbons" of less than homogeneously mixed concrete when compared to a compulsory mixer. As a result, considerable additional mixing time or "dwell time" of the concrete in the rotating/tilting drum mixer is required resulting in fewer loads of concrete being produced in an hour.

It should be understood that so-called compulsory mixers are now in use in Europe and in limited use in North America for mixing soil cement. These mixers include a top loading, parallel rotating shafts with interval and paired counter-rotating paddles, and a bottom discharge feature. In the past, such compulsory mixers have been used in the European market where the total transport envelope allowed is small when compared to North America. As a consequence, such compulsory mixers have not been adapted to high volume portable concrete batching and mixing plants used in North America. A plant of the dimensions of this invention would not have been conceived for the European market (or other markets which have adopted European transport standards) because it would not be allowed to be transported on the highways. It should also be noted that the majority of the compulsory mixers used in North America today are foreign made and are used in a continuous mixing process as opposed to a batch mixing process that this invention utilizes.

In understanding the background of this invention, attention should be directed to the practical consequences of having long erection times for portable concrete batching and mixing plants. First, modern slipform pavers can be moved to a new paving site and set-up within one working day (when short transport distances are involved, transport and set-up of the slipform in a day is feasible). Second, current "portable" concrete batching and mixing plants require between three and five days for an equivalent move with 300 to 400 man hours being devoted to each set-up and tear down. The practical result of the time differential between the movement of the slipform paver and the movement of the current so-called portable batching and mixing plant is interesting to understand.

Taking the case of roadway paving of a four lane divided highway, both directions of traffic are diverted to one side of the highway while concrete placement, paving and curing occurs on the opposite side of the highway. Traffic must be maintained while rehabilitating the concrete road. Curing of newly placed concrete on a highway occupies up to 28 days before traffic is allowed on the highway. There is a considerable interval of time where the nearby batching and mixing plant—required to be nearby to reduce the transport interval—will normally remain idle given the total time interval for plant moving. Moving requires 3 to 5 days to set up and 3 to 5 days to dismantle. Thus the decision is frequently made to leave an erected plant idle and in place for paving the opposite side of a highway. Considered from the standpoint of the contractor, the operating hours of a current portable batch plant are about half the operating hours of modern slip form pavers. Stated in other terms, the contractor must either own an additional batching and mixing plant or lose the opportunity to use the slip form paver in performing other work. Given modern capital requirements (including about $850,000 for a "portable" batch plant and $600,000 for a modern slipform paver), neither alternative is desirable.

Finally, there must be considered the dimension of the North American road transport envelope used in Canada, USA, Mexico, and Australia. Maximally, transported loads over high quality highways are normally limited to trailer vehicles having less than 85 feet length overall, 13 feet 6 inches in height, and under 12 feet in width. It will thus be immediately understood that in producing a high capacity batch plant, the size of the transport envelope works against the design. While relative size is not normally a consideration in determining invention, in what follows transport envelope size is a critical design factor in the design of the two trailer transportable, high capacity concrete batching and mixing plant of this invention.

SUMMARY OF THE INVENTION

A portable concrete mixing plant capable of producing up from 240 to 300 cubic yards or more of concrete per hour (depending on the mixing time required) has two hauling trailers. These trailers are a mixer trailer and an aggregate trailer. Both serve as the transport vehicle chassis and the foundation for the completely erected plant. The aggregate trailer includes three bins (up to four if the trailer length can be legally transported in the state of use), these bins being used respectively for sand, fine aggregate and course aggregate. Weighing belts, one located at the outlet of each bin, convey weighed and humidity measured (if so desired) amounts of sand and aggregate from open top bins to a batch aggregate loading belt for batch loading of a compulsory mixer on the mixer trailer. The side of the aggregate trailer is provided with a bulkhead for a relatively low earthen or aggregate ramp with large width bins enabling a single loader of high capacity to supply the high volume of sand and aggregate required. The aggregate trailer also holds two to three admixture tanks, the dust collection filter for the cement weigh batcher/hopper, a 5,000 gal water tank and the operator control cabin for the entire plant. The mixer trailer supports a twin shaft compulsory mixer on a foundation pad which is top loading for concrete constituents and bottom emptying to an elevating and concrete discharge point to awaiting trucks. Pivotally mounted to the mixer trailer from a horizontal transport disposition to a vertically erect operating position are a multi-compartment air loaded, gravity feed cement silo, and weigh hopper for batch weighing of cement and discharge to the underlying compulsory mixer. The dust collection system for the cement silo is built into the top of the silo. The mixer trailer contains a large diesel generator set, which supplies the required power requirements for the plant and the cement storage guppies. The plant is capable of erection from the transport mode to the mixing mode in less than 8 hours by a three to four man crew without the need for a crane or concrete foundations. Provisions are made for rear wheel steering of the trailers so that precision joining of the plant components can easily occur. This trailer rear wheel steering ability also allows these long trailers to maneuver more easily around corners in confined urban areas and tight radius ramps on highways without scuffing the tires.

Because the plant is modular, the addition of another mixer trailer is possible. Further another ramp bulkhead may be placed on the opposite side of the aggregate trailer. The aggregate bins can be loaded from either or both sides. This modular concept also allows a second mixer trailer to be added to supplement the first mixer trailer. By adding one additional mixer trailer, a contractor can significantly increase the capacity of his plant, delivering uniformly mixed low slump concrete at a rate of over 400 cubic yards per hour depending on the required mixing time to achieve uniformity. This higher concrete plant capacity is sometimes required to be competitive on certain larger highway and airport paving projects. This feature eliminates the need for a contractor to own one complete plant for concrete production in the 240 to 300 cubic yards per hour range and another separate plant for projects requiring concrete production in excess of the 400 cubic yard per hour range.

OBJECTS AND ADVANTAGES OF THE INVENTION

An object of this invention is to provide a high capacity portable batch or concrete plant, which can be moved in just two transporting trailers. The two trailers fit within a North American transport envelope where the trailer is less than 85 feet in length, 13 feet six inches in height, and less than 12 feet in width.

A further object of this invention is to provide a portable high capacity concrete plant, which can be moved with approximately the same speed as a modern slipform paver. The disclosed plant can thus follow the paver and supply the paver with concrete from a plant site within a relatively short distance from where the paver is working (normally within a 12 mile or 40 minute concrete transport interval.) The closer the concrete plant is located to the paver, the fewer concrete hauling trucks are required on the road. This allows the plant to provide the contractor with higher utilization.

An additional object of this invention is to provide a concrete plant that can be erected from the transport envelope or disassembled to the transport envelope in one shift by three to four men without the necessity of assisting erection rigging such as cranes and the like. The plant also eliminates the need for concrete foundations.

An additional object of this invention is that both the mixer and aggregate trailer are provided with steerable air ride axles that allows the plant to be transported at higher transport speeds. These axles allow the trailers to be maneuvered more easily in the tight confines of a roadside plant site or confined urban paving location. Finally, once the plant is on site, the steerable axles allow precision joining of the aggregate trailer to the mixer trailer. Without these axles, a trailer of this length would require multiple and time consuming attempts to join the two trailers together.

An additional object of this plant is to create a modular plant, which can be reconfigured. This reconfiguration can be customized to match the contractor's needs and for minimizing or optimizing the size of the plant site required. In the standard configuration, the plant is arranged with the two trailers oriented 90 degrees to each other. The two trailers can also be arrange side by side or end to end with the addition of auxiliary belts so aggregates can be fed into the mixer. This may be necessary if the plant site is small or the only available site dimensions are limited.

Another object of this invention is to provide a concrete mixing plant that will be accepted in the market unlike the continuous mixing plants. In a continuous plant, cement, water, aggregates and sand are weighed continuously and delivered to the compulsory mixer, which mixes and discharges continuously. This is unconventional and presents a difficult challenge to monitor and assure the concrete quality. The plant of this invention differs from a continuous mixing plant in that it has all the advantages of a continuous plant. These advantage include low profile, and highly transportable. At the same time, the plant is easy to set-up and tear down. The erected plant batches and weighs the cement, water, aggregates and sand and delivers them to the compulsory mixer which mixes these components in a batch in a conventional manner.

It will be noted that this plant uses weighing belts in lieu of using a weigh batcher hopper to weigh each batch of aggregates and sand discharged from the storage bins. Although weighbelts are unconventional for concrete plant (and more commonly found on an asphalt plant), they are as accurate as batch weighing of aggregates yet allow a significantly lower profile plant. Of course, as previously described, this plant mixes the batch of concrete constituent materials in a compulsory mixer in lieu of a tilting drum type mixer.

Another important object of this invention is because conventional weigh/batch bins of the aggregate and sand bins have been eliminated by using weighing belts, this invention's lower height storage bins can be reached by a front end loader with the aid of a ramp. This feature eliminates the loading bins and loading conveyors thus improving mobility and speeding up erection or disassembly time. The width and capacity of this invention's bins allow a single loader operator to feed sufficient material to the plant to sustain the design production capacity. If increased plant throughput is desired, the aggregate trailer can have a second ramp bulkhead on the opposite side of the bins so a second front-end loader can be used. For example, such a second loader can be dedicated to filling the sand bin while the other loader concentrates on charging the aggregate bins.

Another advantage of this invention is that the enclosed mixer design is quieter and produces less dust than a conventional plant. This allows this plant to be utilized in a more urban setting. Because of this plant's design, it is more environmentally friendly than conventional plants. It is a quieter plant to run than conventional plants thus making it more practical to use in urban areas where high decibel readings could prevent a plant from being used. Because of the plant enclosed mixer design, dust problems are significantly less than a conventional plant where open tilting mixing drums allows dust to escape into the environment.

An advantage of the disclosed design is that for the first time, a high capacity batching and mixing concrete plant is disclosed. This plant can be set up and torn down in ⅓rd to ⅕th the time of a conventional concrete plant of the same capacity and can follow a modem paver with the same transport time, erection time and tear down time. In short, the disclosed portable concrete plant is capable of both following and supplying its slipform paving counterpart in timing and capacity resulting in tandem economic package for the paving contractor.

An additional object of this invention is to be able to mix a greater variety of concrete material mixtures at various slumps and consistencies.

BRIEF DESCRIPTION OF THE DRAWINGS

Other objects, features and advantages of this invention will become more apparent upon reading the following specification and attached drawings in which.

DESCRIPTION OF THE PREFERRED EMBODIMENTS

Figure 1:
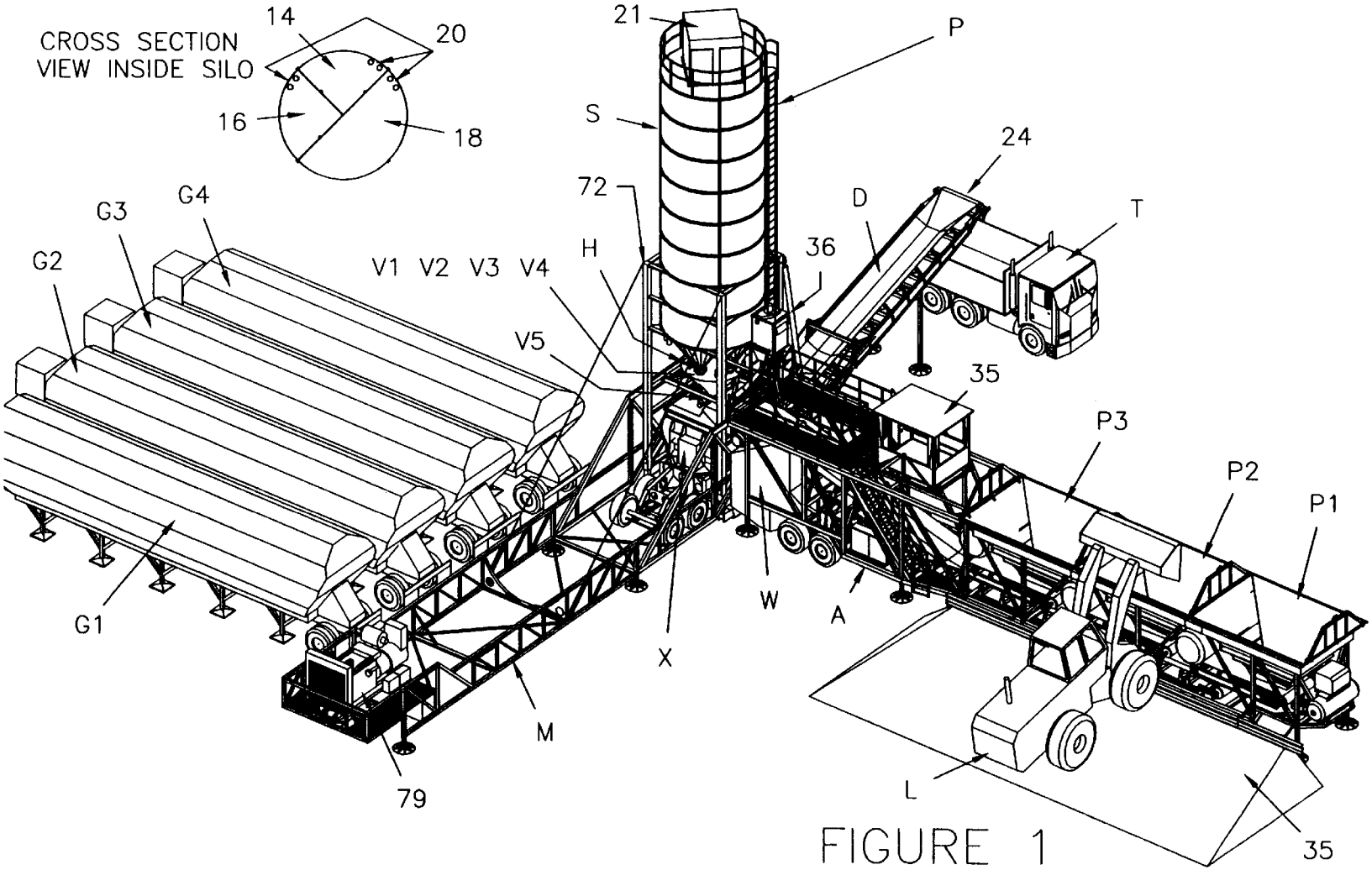
FIG. 1 is a plan view of the operating portable plant in an erect disposition with the aggregate trailer including the required water tank and defining three side-by-side bins with sand, fine aggregate, and course aggregate respectively for weigh belt conveyance from each bin to a central aggregate conveyor off loading into the adjacent compulsory mixer and the mixer trailer having pneumatic cement dispensing "guppies" (or "pigs" or "blimps") for pneumatic loading of the silo with the concrete off loading belt shown emptying the compulsory mixer at the bottom and off loading to a 12 yard capacity concrete truck at the top for transport to a paving site.

Referring to FIG. 1 assembled batch plant P is illustrated. This plant includes mixer trailer chassis M, aggregate trailer chassis A here shown disposed at right angles one to another.

The operational portions of the plant are relatively easy to understand. Cement is blown from multiple so-called cement guppies G1–G4 through individual flexible air hoses to the air transport lines 20 inside each silo compartment 14, 16, and 18 in cement silo S. For example, one guppy is typically connected to a single flexible air line which connects to one air transport line 20 inside of one compartment. This method of filling the silo compartments can keep up to three types of cementaceous material separated. Air from this transport escapes the silo through air filter assembly 21 thus retaining suspended cements dust inside the silo. Each silo compartment discharges through its respective pneumatically operated valve V1–V4 into weighing hopper H. Each cement is weighed in the weighing hopper H which is suspended from the silo frame 72 on loadcells. After weighing is complete, cements are discharged to underlying mixer X through pneumatically operated valve V5 located at bottom of weighing hopper H.

Figure 2:
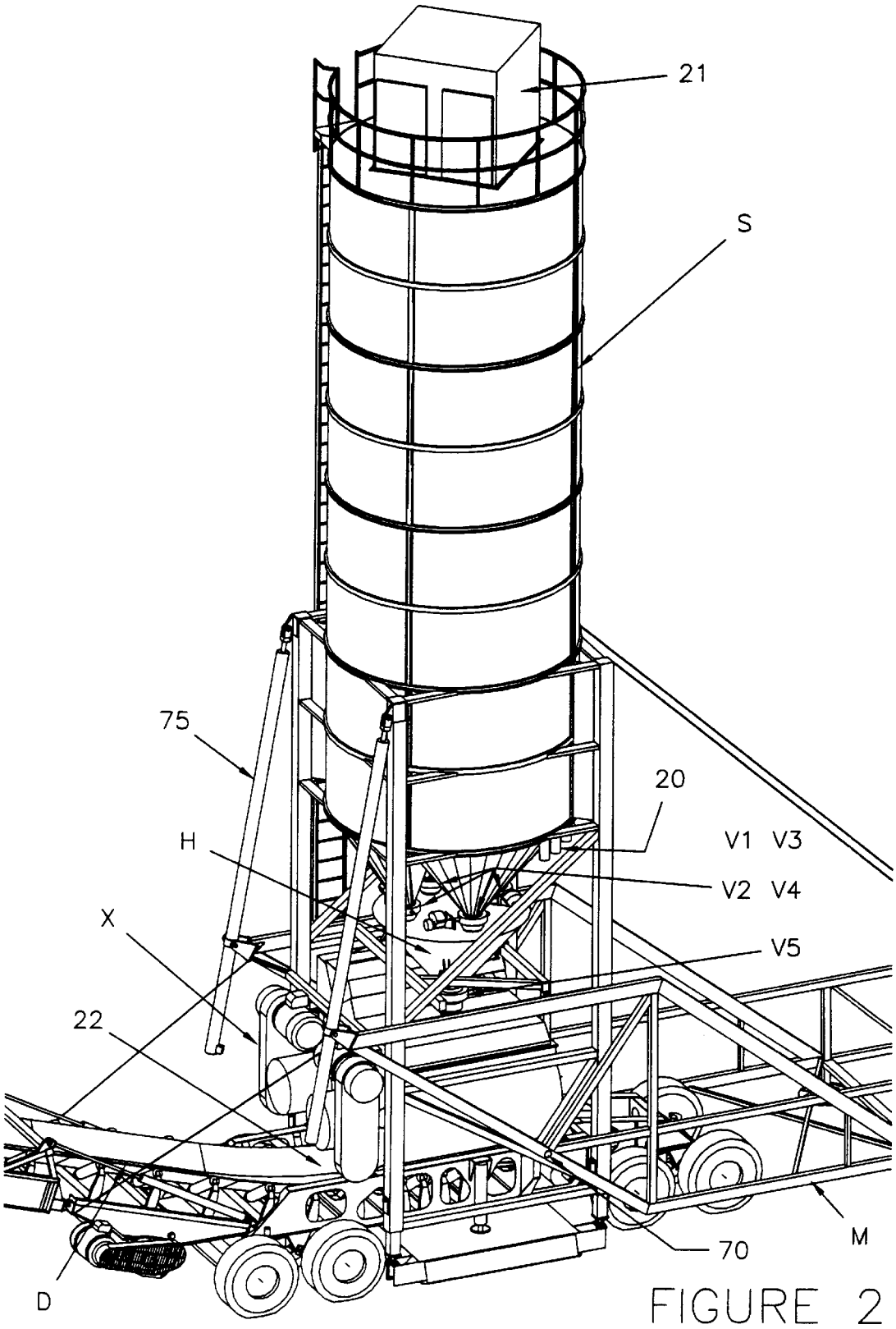
FIG. 2 is a perspective view of the portable plant at the cement silo illustrating gravity feed first to a weigh hopper and second to the open compulsory mixer with the concrete off loading conveyor taking thoroughly mixed concrete from the bottom discharge of the compulsory mixer for discharge.

Referring to FIG. 2, discharge of batch mixed concrete occurs from under mixer X to discharge conveyor D. Discharge conveyor D receives mixed concrete at receiving end 22 and discharges the concrete at discharge end 24 to transport truck T. (See FIG. 1.)

Figure 6:
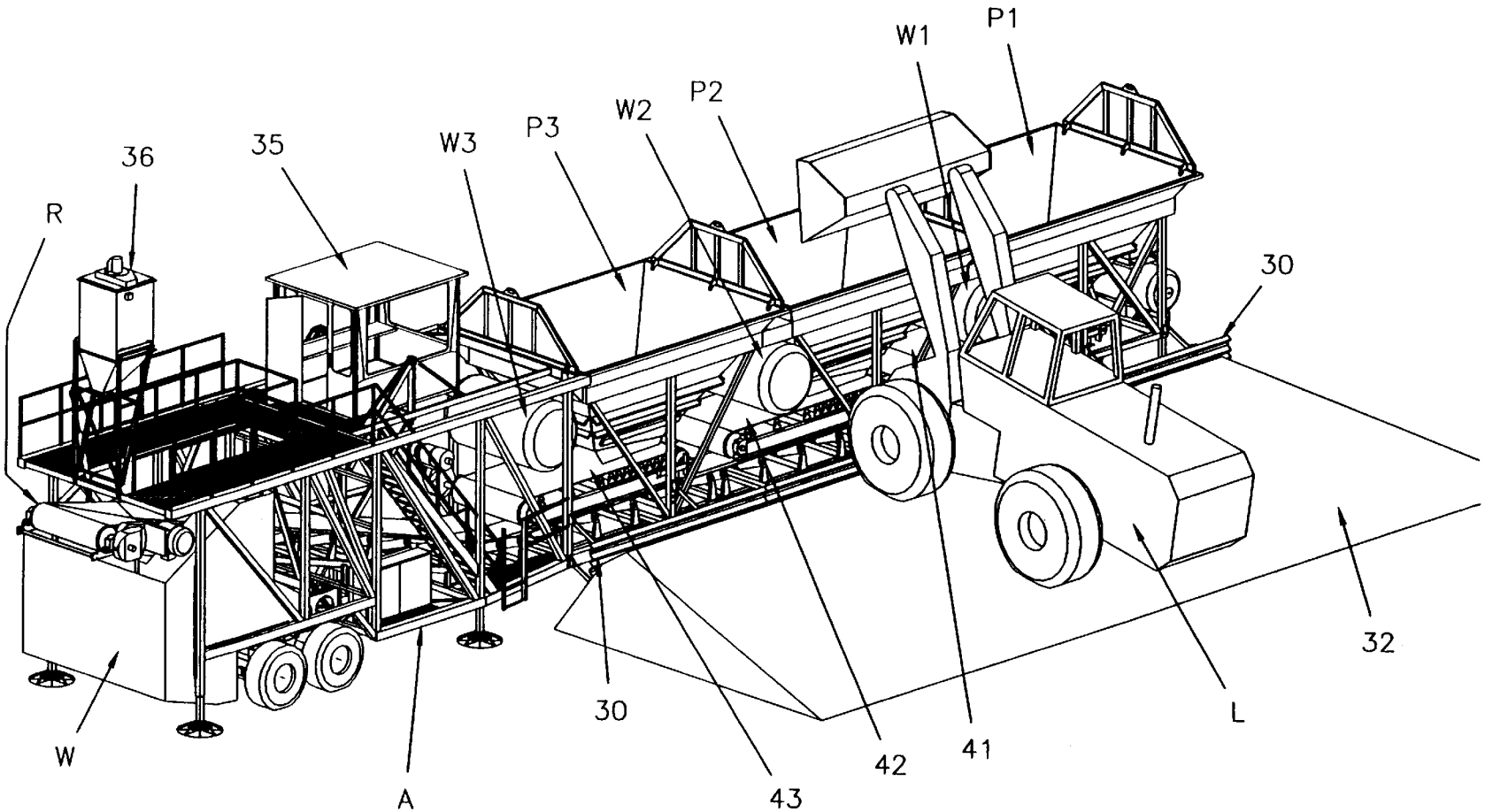
FIG. 6 is a perspective view of the aggregate trailer in the erect disposition being supplied by a front end loader with sand, fine aggregate, and course aggregate.

Referring to FIG. 6, aggregate trailer chassis A is also easy to understand. It includes as major components three aggregate/sand hoppers P1–P3, water tank W, and aggregate conveyer R for discharging in batch loads aggregate/sand to mixer X. In addition, water admixture tanks W1–W3 are utilized for required chemical treating of mix water to achieve desired concrete chemistry. These tanks can be seen positioned between the respective aggregate/sand hoppers P1–P3.

Figure 12:
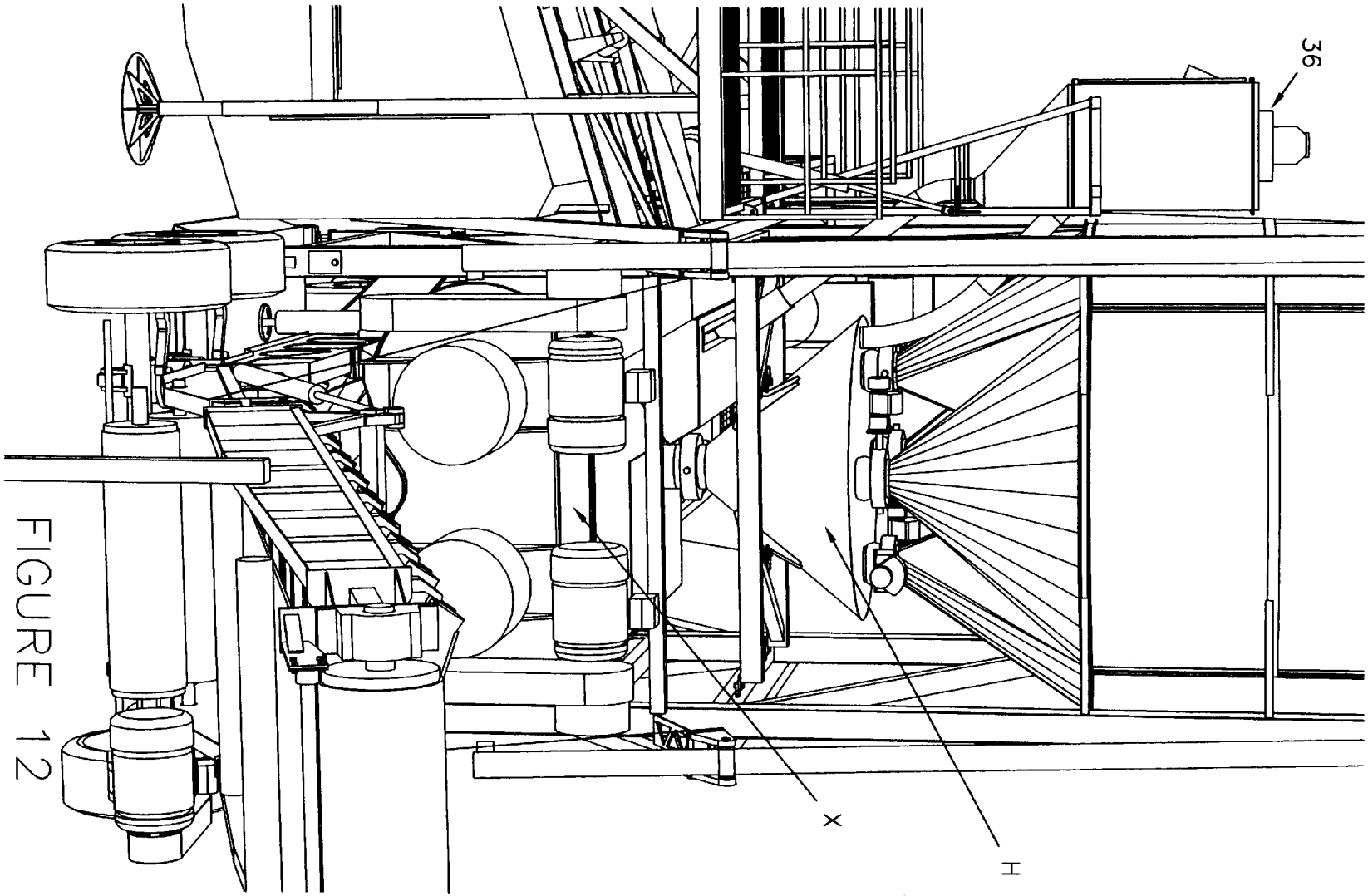

Aggregate trailer chassis A also supports control cabin 35 and hopper dust filter 36 for controlling cement dust outflow from weigh hopper H and mixer X. (See FIG. 12.) In this way, assembled batch plant P is made relatively environmentally safe for disposition in semi urban areas. Also, because of the improved mixing efficiency of the compulsory mixer X compared to state of the art drum mixers, less cements dust is generated so the size of the dust filter can be smaller. This fact allows the weigh hopper and mixer dust filter system to be easily transported on the aggregate trailer chassis A without the need for an auxiliary trailer for a large dust control system.

Aggregate trailer chassis A disposes along at least one-side ramp barriers 30. Typically, fill ramp 32 is place against ramp barriers 30 to enable ramp loading by loader L of the respective bins.

Some attention can be directed to the discharge out of the respective aggregate/sand hoppers P1–P3. Specifically, each bin discharges to conveying weigh belt 41–43, which simultaneously conveys and weighs discharged sand and/or aggregate. These belts in turn discharge to aggregate conveyer R. Thus, for each batch of concrete made in mixer X, weighed amounts and mixtures of cement, aggregate, and water can be rapidly and sequentially funneled to mixer X.

Figure 3:
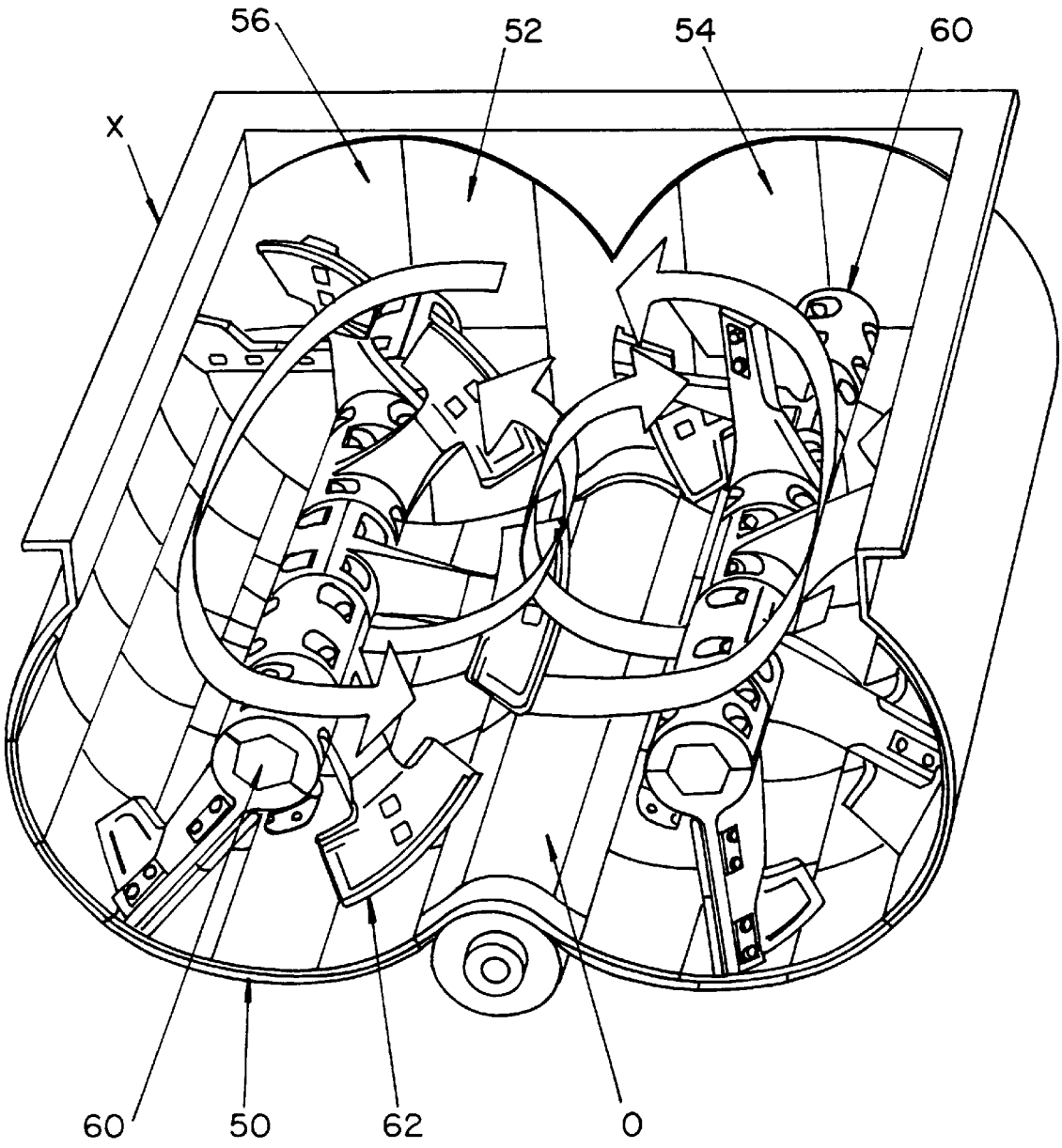
FIGURE 3 (PRIOR ART)
FIG. 3 is a diagram of the prior art compulsory mixer used with the batch mixing of this portable batch plant illustrating top loading and bottom discharge of concrete from the compulsory mixer.

Referring to FIG. 3, operation of mixer X is easy to understand. Illustrated compulsory mixer X includes casing 50 with generally side-by-side cylindric portions 52, 54 and open top 56. Centrally of each cylindric portion 52, 54 there are disposed rotating shafts 60 with attached paddles 62. Rotation is such that the respective attached paddles 62 counter-rotate on the bottom of casing 50 towards one another during mixing. At the end of the mixing cycle, bottom discharge opening O moves to the open position. As seen in FIG. 1, discharge of the mixed concrete can then occur to discharge conveyor D and to transport truck T.

Before discussing the disassembly and transport of the illustrated assembled batch plant P, some observations may be made relative to the speed of operation. Compulsory mixer X has a total capacity of 6 cubic yards of compacted concrete. An example of a mixing cycle for one batch of concrete is on the order of 90 seconds. At this rate assembled batch plant P will out put 240 cubic yards of concrete per hour. If an acceptable and uniformly mixed concrete is possible using a reduced mixing time, then the mixing cycle can be reduced to 60 seconds by reducing the time the ingredients are mixed in the mixer. By reducing the mix cycle to 60 seconds the assembled plant will out put 360 cubic yards of concrete per hour.

Having set forth the general construction and operation of assembled batch plant P, the disassembly of the plant can now be set forth. Since assembly of the plant is the opposite of the disassembly, only disassembly will be set forth.

Figure 4:
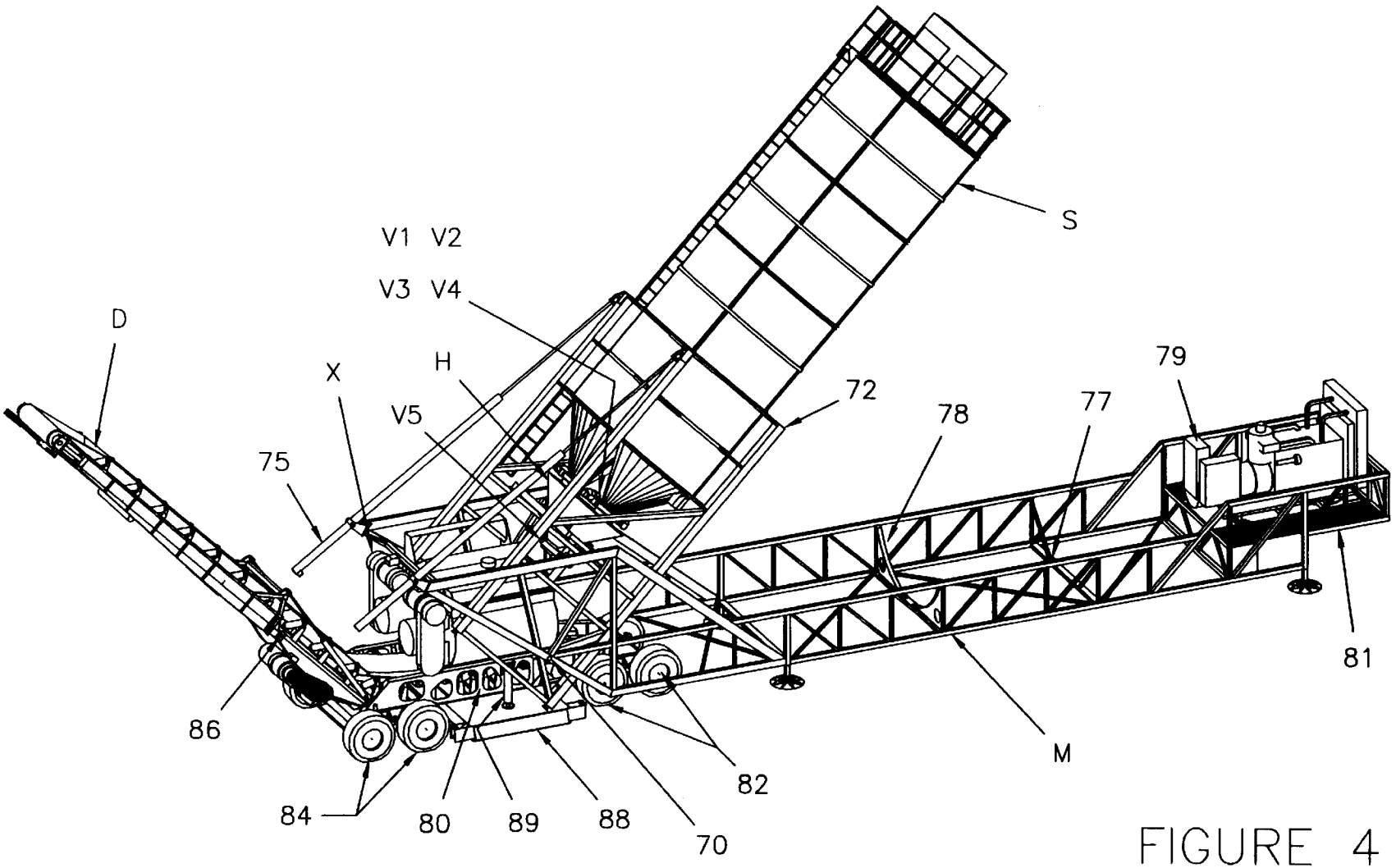
FIG. 4 is a perspective of the mixer trailer collapsing the silo from the erect disposition toward the transport disposition with the conveyor for the mixed concrete being manipulated toward the transport disposition.

Referring to FIG. 4, it will be seen that cement silo S has been emptied and is under the process of being pivoted on silo pivots 70. Silo pivots 70 enable silo frame 72 to pivot the entirety of cement silo S. Such pivotal motion occurs under the influence of double acting hydraulic cylinders 75 expanding from the top and rear of mixer trailer chassis M.

It will be further seen that mixer trailer chassis M defines a generally U-shaped opening 77 into which cement silo S is received at silo support 78. Further, and forward of U-shaped opening 77, it will be seen that generator set 79 is mounted in a position overlying fifth wheel tractor connection 81.

Figure 5:
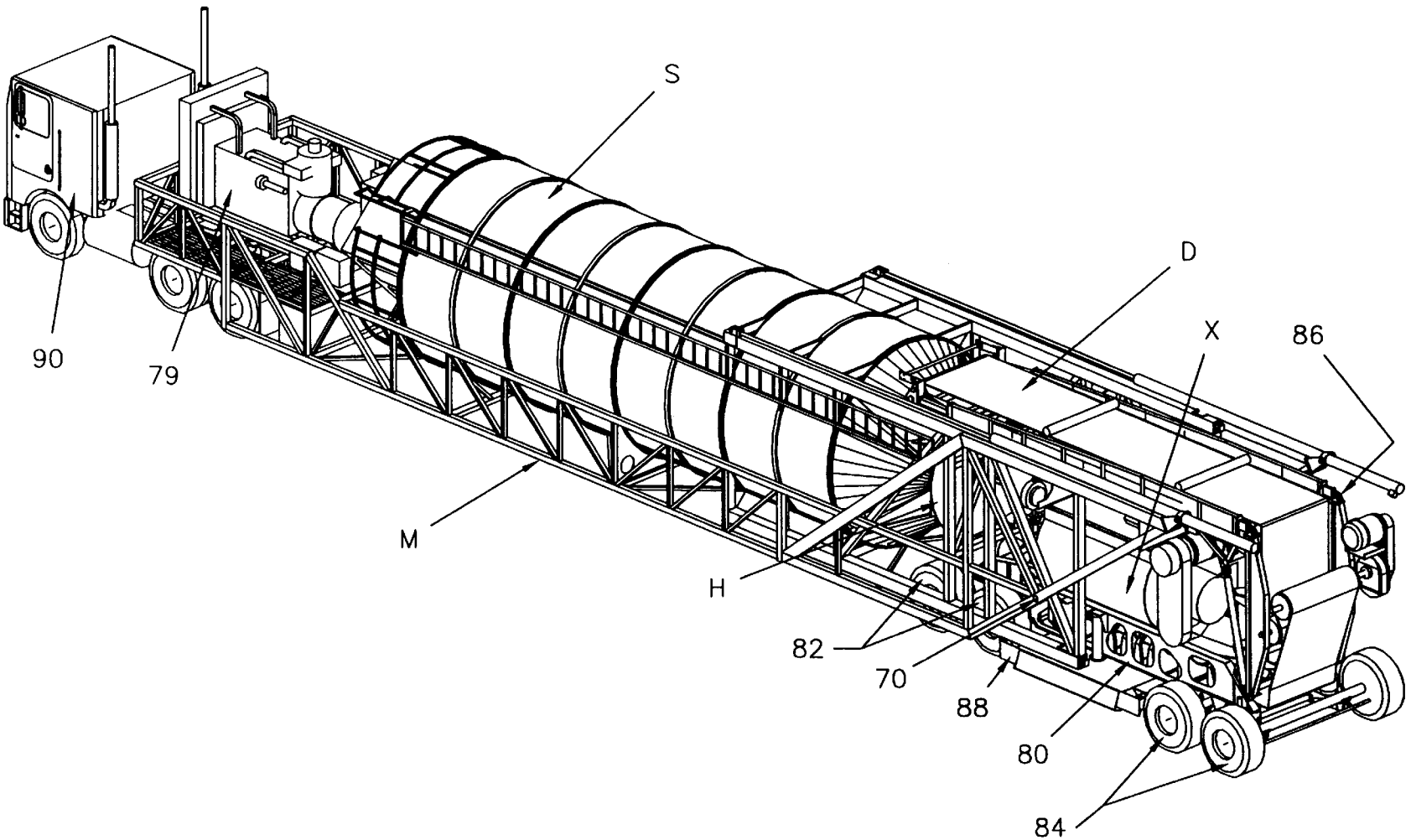
FIG. 5 illustrates the mixer trailer under transport with the structural element of the portable batch plant now converted to a transporting trailer chassis.

At the same time, discharge conveyor D is elevated by a powered cable winch and is readied to be hydraulically articulated at conveyor hinge 86. As shown in FIG. 5, discharge conveyor D folds at conveyor hinge 86 overlying mixer X and cement silo S when transport occurs.

Returning to FIG. 4, some additional attention can be devoted to the so-called jeep wheel frame 80 which attaches to the rear of mixer trailer chassis M using silo pivots 70. Specifically, jeep wheel frame 80 includes forward tandem wheels 82 and rear tandem wheels 84. From the bottom of jeep wheel frame 80 there extends mounting platform 88. This mounting platform 88 is moveable by two hydraulic cylinders 89 towards and away from jeep wheel frame 80. The two hydraulic cylinders 89 are independently controllable so that the mixer trailer chassis can be set level before the silo is erected.

Figure 11:
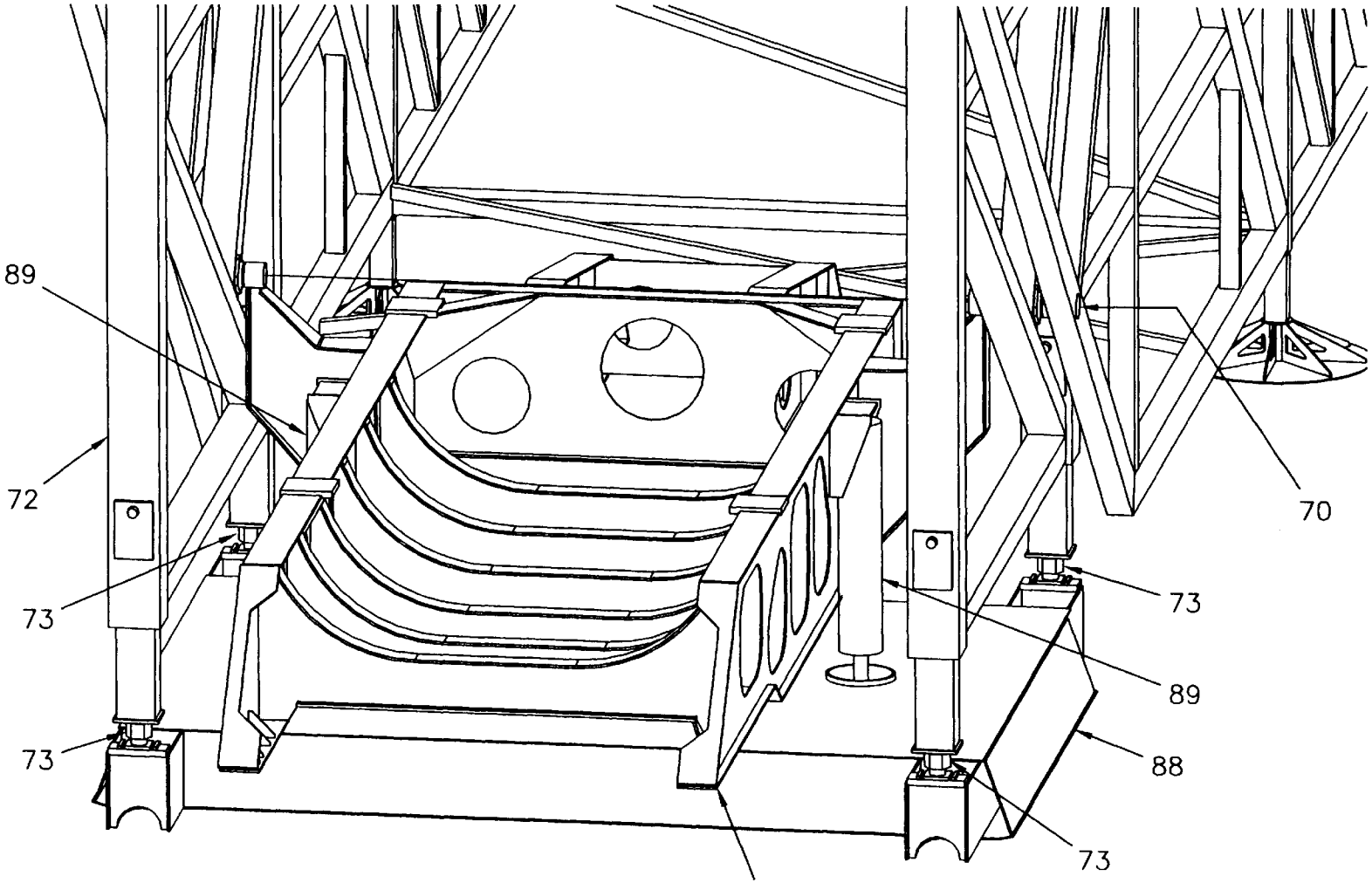
FIG. 11 is a detail showing the jeep (without wheels), the mounting platform and leveling cylinders; and, FIG. 12 is a detail showing the weighing hopper, mixer, and dust filter arrangement when plant is in operation.

Referring to FIG. 11, when cement silo S is erected, the adjusting screw 73 mounted at the end of each of the four legs of silo frame 72 rest directly on mounting platform 88 which contacts the ground and forms the required relatively heavy foundation for mixer X and cement silo S. Concrete foundations are avoided and plant erection occurs with relative ease.

Finally, and referring to FIG. 5, transport of mixer trailer chassis M with now horizontal cement silo S, compulsory mixer X, and folded discharge conveyor D is illustrated. The weigh hopper H is rigidly mounted on transport brackets attached to silo frame 72 so the loadcells are unloaded and will not be damaged during transport. It will be noted that the weight of generator set 79 distributed by the fifth wheel to the driving tandem axles of the pulling tractor 90.

It should be noted that jeep wheel sets 82 and 84 are preferably provided with steering capability. Such capability is needed not only for the transport of mixer trailer chassis M and the overall 85 foot load pulled by pulling tractor 90, but additionally enable precision backing of mixer trailer chassis M when connection to aggregate trailer chassis A is required.

Figure 7:
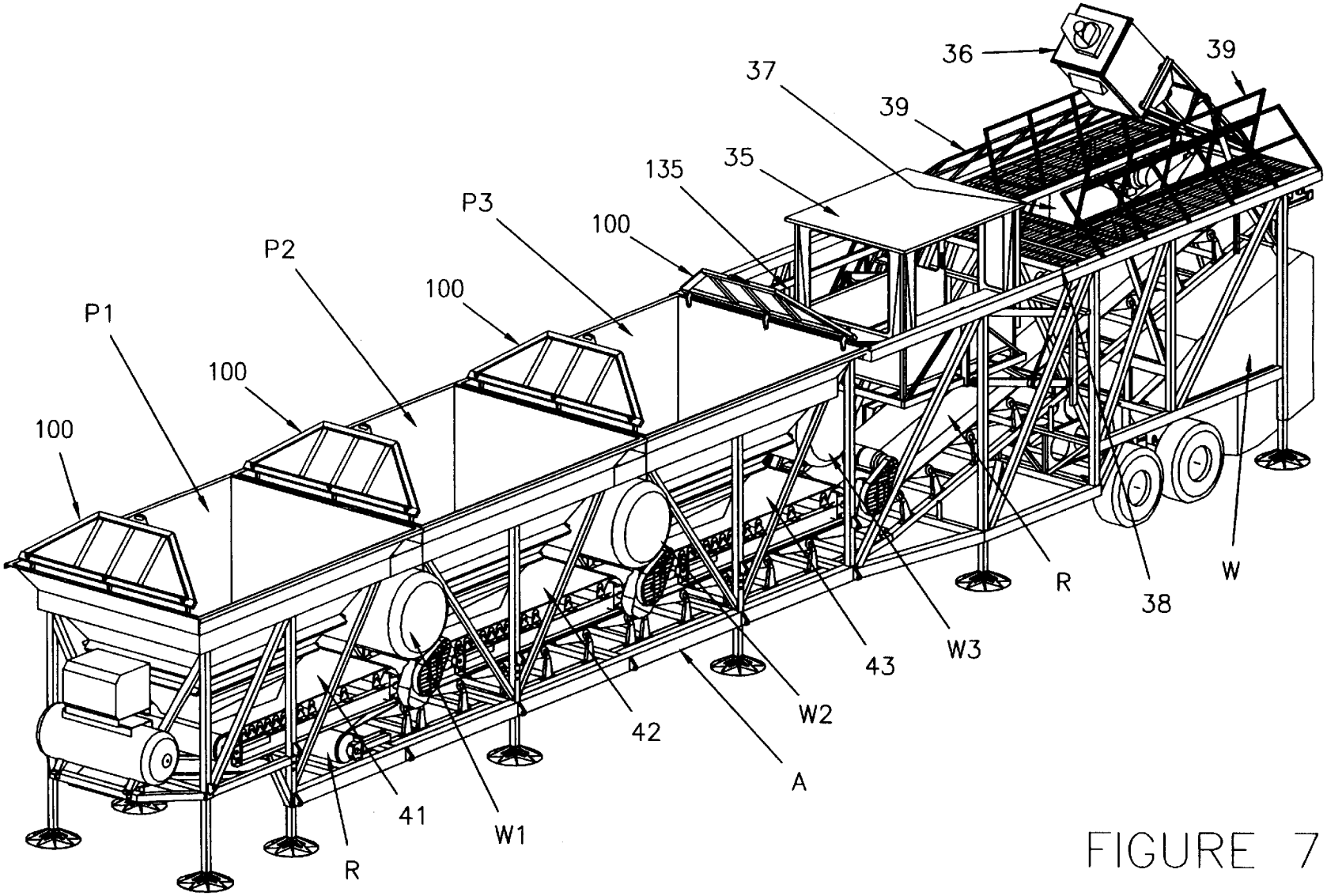
FIG. 7 is a perspective view of the aggregate trailer moving from the erect disposition to the transport disposition.

Referring to FIG. 7, the disassembly of aggregate trailer chassis A is illustrated. Simply stated, aggregate/sand bins P1–P3 have bulkhead panels 100 at the ends of and between the respective bins. These bulkhead panels 100 are moved downward into the bins for transport. At the same time, control cabin 35 is received into a corresponding control cabin recess 135 in aggregate trailer chassis A. Hopper dust filter 36 pivots downward into aggregate trailer chassis A into aperture 37 within deck 38. Handrailing 39 pivots downward onto the deck 38.

Figure 8:
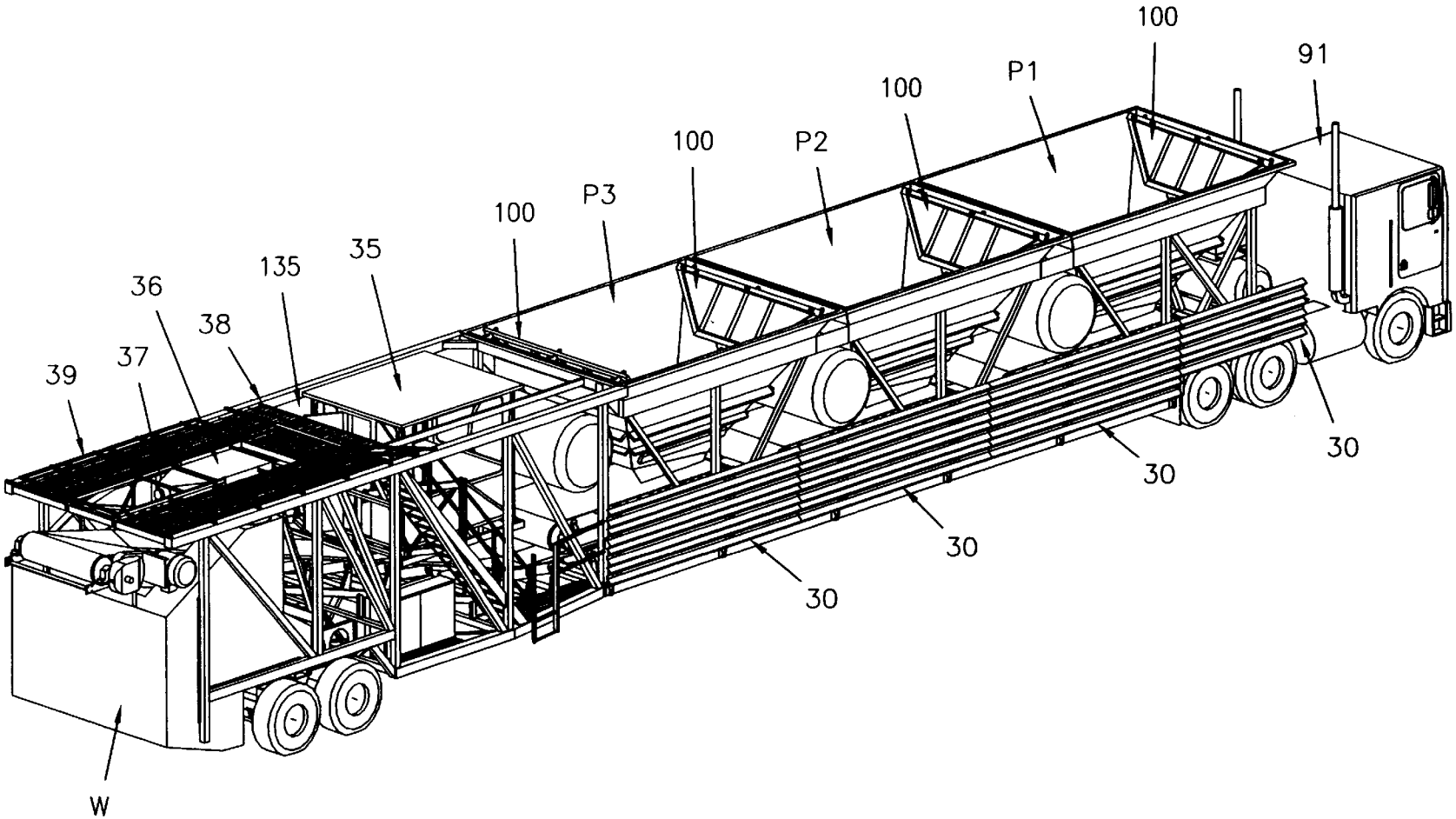
FIG. 8 is the aggregate trailer under transport with the structural element of the aggregate bins and associated water tank now converted to a transporting trailer chassis.

Finally, and referring to FIG. 8, towing tractor 91 is shown pulling aggregate trailer chassis A.

Figure 9:
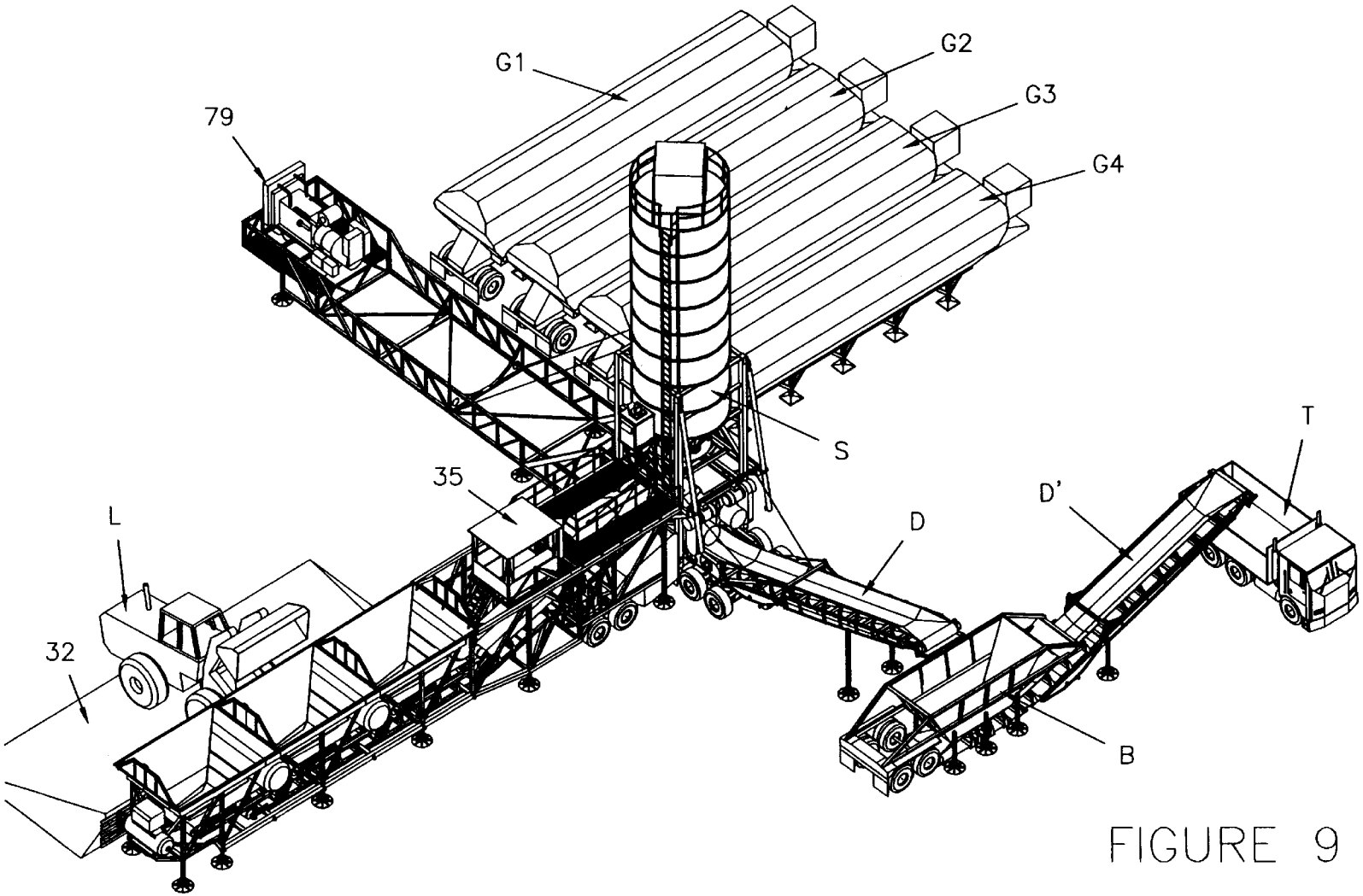
FIG. 9 is a batch plant similar to that illustrated in FIG. 9 having buffer storage.

Referring to FIG. 9, the batch plant of FIG. 1 is illustrated with a buffer storage trailer B. In the case illustrated, buffer storage trailer B receives mixed concrete at the top and discharges to a conveyor D'. The purpose of the buffer storage trailer B is to allow uninterrupted operation of the plant if the transport truck T is not immediately available when plant discharge conveyor D is ready to discharge the mixer X. Another benefit of the buffer storage trailer is that the mixer can run at maximum capacity without concern to the capacity of each transport truck. For example, if the transport truck cannot hold more than 10 cubic yards of concrete, then the mixer can mix two batches of 6 cubic yards (12 total) and the 2 extra yards of concrete can remain in the buffer storage trailer while the next transport truck is getting into position to receive its load. In this example, if the buffer storage trailer is not used, the mixer runs partially filled to make two batches of 5 cubic yards each (10 total).

Figure 10:
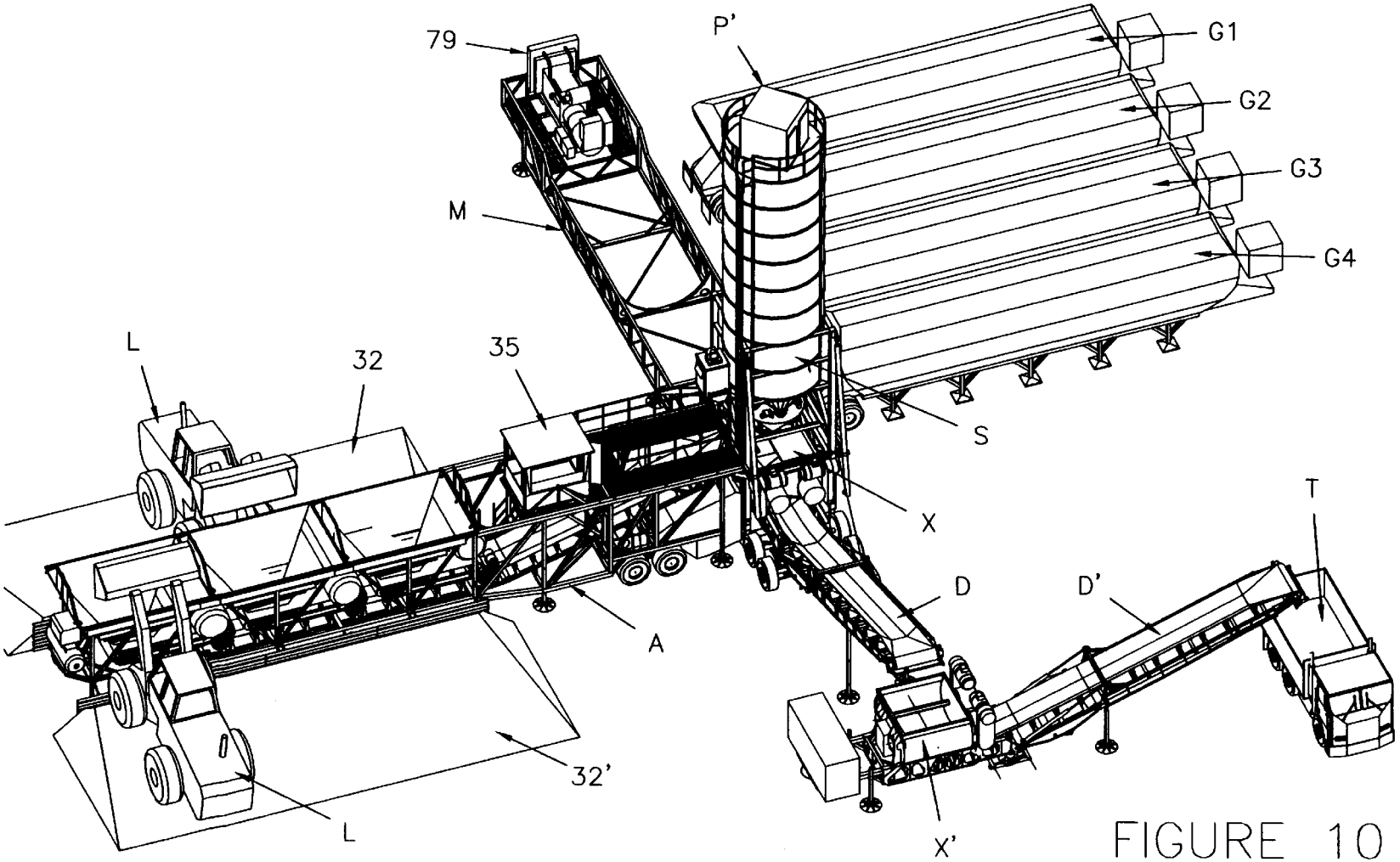
FIG. 10 is a detail of a second mixer trailer for series addition to the first mixer trailer to enable total output of the batch plant to be increased.

Some attention can be directed to the disposition of assembled batch plant P' as illustrated in FIG. 10. This plant differs from that shown in FIG. 1 in that two mixers X–X' are utilized. Specifically, first mixer X and discharge conveyor D is used in a generally open and continuous mode to mix constituents of concrete. Second mixer X' and discharge conveyor D' is utilized to batch mix on a shortened cycle—in the order of 45 seconds—concrete and to discharge to transport truck T. Utilizing this configuration, production rates of over 400 cubic yards per hour can be achieved. It will also be observed that due to the increasing through put of assembled batch plant P', it is necessary to service aggregate trailer chassis A with loaders L, L' from opposite sides of the respective aggregate/sand hoppers P1–P3.

What is claimed is:

1. A mixer trailer comprising in combination:

a trailer chassis having transporting wheels at a first end and a coupling to a tractor at a second end;

a compulsory mixer mounted to the trailer chassis having a lower constituents discharge configured to open and close for batch mixing of concrete and an overlying opening for receiving constituents, the compulsory mixer for receiving constituents through the overlying opening, mixing the constituents to form mixed constituents, and discharging the mixed constituents through the lower constituents discharge;

the compulsory mixer is mounted adjacent the second end of the mixer trailer chassis, a jeep frame having jeep wheels at one end and a fifth wheel connected to the tractor at the other end supports the chassis at the coupling to the tractor at the second end of the trailer chassis, the jeep frame pivotal on the trailer chassis at the second end in order to evenly distribute the weight of the compulsory mixer when traveling over the ground between the tractor and the jeep wheels;

a mixed constituent conveyor having an end underlying the lower constituents discharge of the compulsory mixer for receiving the mixed constituents and transporting the mixed constituents to a discharge end of the conveyor;

a cement silo for mounting on the trailer chassis and moveable between a horizontal transport position and a vertical gravity feed position overlying the compulsory mixer, the cement silo when in the vertical gravity feed position having at least one inlet and at least one bottom outlet for gravity discharge of cement;

a weigh hopper mounted between the bottom outlet of the cement silo and the overlying opening of the compulsory mixer to enable the gravity discharge of cement to be weighed before discharge into the overlying opening of the compulsory mixer; and, a pad mounted along the bottom of the trailer chassis for forming a foundation support for the mixer, the cement silo and weigh hopper.

2. A mixer trailer according to claim 1 comprising in further combination:

apparatus for elevating the discharge end of the mixed constituents conveyor for discharge to a transporting truck.

3. A mixer trailer according to claim 1 comprising in further combination:

the cement silo is mounted to the trailer chassis on a pivot adjacent the compulsory mixer for movement from the horizontal transport position to the vertical gravity feed position.

4. A mixer trailer according to claim 3 comprising in further combination:

the cement silo is pivotally mounted to the trailer chassis for movement from the horizontal transport position to the vertical gravity feed position; and, fluid actuated cylinders attached to the cement silo at a position offset with respect to the pivot cause movement of the silo from the horizontal transport position and the vertical gravity feed position.

5. A mixer trailer according to claim 3 comprising in further combination:

a mounting platform hydraulically extended from the trailer chassis;

two independent adjustable cylinders extending from the mounting platform to the mixer trailer chassis so that the mixer trailer chassis can be set level for pivoting the silo into precise vertical orientation.

6. A mixer trailer according to claim 3 comprising in further combination:

a plurality of adjusting screw mechanisms on the silo frame for directly interfacing with the mounting platform to enable the cement silo to be set in a level, vertical orientation to compensate for settling of underlying soil during operation.

7. A mixer trailer according to claim 3 comprising in further combination:

load cells suspending the weigh hopper under the cement silo attached to the silo frame; and, a direct frame attachment for the weigh hopper to the trailer chassis so that the weigh hopper can be securely attached during transport and erection in order to avoid damaging the load cells.

8. A mixer trailer according to claim 1 comprising in further combination:

a generator set mounted to the trailer chassis at an end opposite from the compulsory mixer.

9. A mixer trailer according to claim 1 comprising in further combination:

the constituents off loading conveyor folds relative to the trailer chassis between an extended position for off loading mixed constituents to constituents transporting vehicles and a folded disposition within the trailer chassis of the compulsory mixer trailer.

10. A wet batch concrete plant comprising in combination:

a mixer trailer, the mixer trailer including;

a mixer trailer chassis having transporting wheels at a first end and a coupling to a tractor at a second end;

a compulsory mixer mounted to the mixer trailer chassis having a lower constituents discharge configured to open and close for batch mixing of concrete and an overlying opening for receiving constituents, the compulsory mixer for receiving constituents through the overlying opening, mixing the constituents to form mixed constituents, and discharging the mixed constituents through the lower constituents discharge;

the compulsory mixer is mounted adjacent the second end of the mixer trailer chassis;

a jeep frame having jeep wheels at one end and a fifth wheel connected to the tractor at the other end supports the chassis at the coupling to the tractor at the second end of the trailer chassis, the jeep frame pivotal on the trailer chassis at the second end in order to evenly distribute the weight of the compulsory mixer when traveling over the ground between the tractor and the jeep wheels;

a mixed constituent conveyor having an end underlying the lower constituents discharge of the compulsory mixer for receiving the mixed constituents and transporting the mixed constituents to a discharge end of the conveyor;

a cement silo for mounting on the mixer trailer chassis and moveable between a horizontal transport position and a vertical gravity feed position overlying the compulsory mixer, the cement silo when in the vertical gravity feed position having at least one inlet and at least one bottom outlet for gravity discharge of cement;

a weigh hopper mounted between the bottom outlet of the cement silo and the overlying opening of the compulsory mixer to enable the gravity discharge of cement to be weighed before discharge into the overlying opening of the compulsory mixer; and, a pad mounted along the bottom of the trailer chassis for forming a foundation support for the mixer, the cement silo and weigh hopper;

an aggregate trailer, the aggregate trailer including:

an aggregate trailer chassis having a coupling to a tractor at one end and steerable transporting wheels at an opposite end;

at least two bins defined within the aggregate trailer chassis, each bin defining an open top for receiving aggregate and/or sand and having an operable opening at a bottom of the bin for discharging the aggregate and/or sand;

weigh conveyors underlying each operable opening of bins for receiving, weighing, and conveying to a destination aggregate and/or sand from the bottom of the bin;

an aggregate collection conveyor disposed under the destination of the weigh conveyors having a collection end for collecting aggregate and/or sand from each of the at least two bins at the weigh conveyors and an outlet end for transporting the aggregate and/or sand;

ramp barriers attached to a side of the aggregate trailer chassis for permitting earthen or ravel ramps to be held to the side of the aggregate trailer chassis, the ramp barriers moveable between a first transport position elevated and adjoining the aggregate trailer chassis and a second lowered position for receiving and retaining portions of an earthen or gravel ramp.

11. A wet batch concrete plant according to claim 16 comprising in further combination:

at least one pair of the transporting wheels on the compulsory mixer trailer and the aggregate trailer are steerable; and, the steering linkage is automatically actuated during transport by a wedge that mates to the pulling tractor's fifth wheel plate.

12. A wet batch concrete plant according to claim 10 comprising in further combination:

the compulsory mixer trailer includes a major axis longitudinally of the compulsory mixer trailer;

the aggregate trailer includes a major axis longitudinally of the aggregate trailer with the aggregate collection conveyor disposed along the major axis at one end of the aggregate trailer; and, the aggregate trailer couples to the compulsory mixer trailer with the longitudinal axes of the aggregate trailer and the compulsory mixer trailer intersecting one to another with the discharge end of the aggregate conveyor overlying the overlying opening of the compulsory mixer.

13. A wet batch concrete plant according to claim 12 comprising in further combination:

the major axes intersect at 90°.

14. A wet batch concrete plant according to claim 10 comprising in further combination:

a second compulsory mixer trailer including:

a second compulsory mixer trailer chassis having a connection to a tractor at one end and transporting wheels at the opposite end;

a second compulsory mixer mounted to the second compulsory mixer trailer chassis for receiving mixed concrete constituents, mixing the received concrete constituents, and discharging mixed concrete.

15. A wet batch concrete plant according to claim 10 further comprising in combination:

a second compulsory mixer placed in series with the first compulsory mixer for increasing the throughput of the concrete plant.

16. A wet batch concrete plant according to claim 10 comprising in combination:

a buffer storage bin;

the buffer storage bin for receiving mixed concrete from the concrete off loading conveyor and buffer storing concrete.

17. A wet batch concrete plant according to claim 10 comprising in further combination:

a hopper dust filter system arranged to collect cements dust from both the weigh hopper and the compulsory mixer during loading and discharge;

the hopper dust filter system is mounted on and integral to the aggregates trailer and hydraulically pivoted to and from operational position without additional support equipment.

* * * * *